US005954193A

United States Patent [19]

Bartee

[11] Patent Number: 5,954,193

[45] Date of Patent: Sep. 21, 1999

[54] ART SUPPLY BAG

[76] Inventor: JoAnn B. Bartee, 3663 Molaree Dr., Pensacola, Fla. 32503-3144

[21] Appl. No.: 09/102,189

[22] Filed: Jun. 22, 1998

[51] Int. Cl.[6] ..... B05C 17/00; B65D 30/22

[52] U.S. Cl. ..... 206/1.7; 383/38; 383/66; 383/104

[58] Field of Search ..... 206/1.7, 1.8, 1.9; 383/38, 40, 104, 119, 66

[56] References Cited

U.S. PATENT DOCUMENTS

| | | | |
|---|---|---|---|
| 2,517,757 | 8/1950 | Adlerstein | 383/66 |
| 3,038,513 | 6/1962 | Hamlett | 383/66 |
| 3,134,416 | 5/1964 | Magyar | 206/1.7 |
| 3,156,213 | 11/1964 | Patten | 383/104 |
| 3,870,132 | 3/1975 | Hanley | 190/52 |
| 3,912,055 | 10/1975 | Malooly | 190/52 |
| 4,061,224 | 12/1977 | Fuhri | 206/1.7 |
| 4,078,595 | 3/1978 | Mittelmann | 150/30 |
| 4,096,929 | 6/1978 | Frey et al. | 190/42 |
| 4,142,627 | 3/1979 | Szegi | 206/1.7 |
| 4,162,005 | 7/1979 | Linger | 206/362 |
| 4,212,377 | 7/1980 | Weinreb | 190/52 |
| 4,236,615 | 12/1980 | Ginat | 190/52 |
| 4,294,348 | 10/1981 | Hastings | 206/1.7 |
| 4,335,812 | 6/1982 | Koves | 206/1.8 |
| 4,444,306 | 4/1984 | Benaquista | 206/1.7 |
| 4,752,008 | 6/1988 | Pratt | 206/579 |
| 4,812,054 | 3/1989 | Kirkendall | 383/66 |
| 5,078,508 | 1/1992 | Johan et al. | 383/109 |
| 5,813,445 | 9/1998 | Christman | 383/38 |
| 5,868,227 | 2/1999 | Garcia | 383/66 |

*Primary Examiner*—Paul T. Sewell
*Assistant Examiner*—J. Mohandesi
*Attorney, Agent, or Firm*—Peter Loffler

[57] ABSTRACT

A art supply bag has two separate compartments for carrying supplies as well as a paint pallet is comprised of a generally rectangular shell member having a base, a first wall, a second wall, and a third wall extending upwardly from the base with a fourth wall connecting the first wall and the third wall. A support structure is disposed within the shell member and separates the shell member into a first upper compartment and a second lower compartment and protects the contents within the bag. A flap, which provides access to the second compartment, is attached to the base and is removably securable to the fourth wall by cooperating hook and loop material, snaps, zipper, etc. The art supply bag may have casters, or may be attached to a frame, itself having casters.

7 Claims, 4 Drawing Sheets

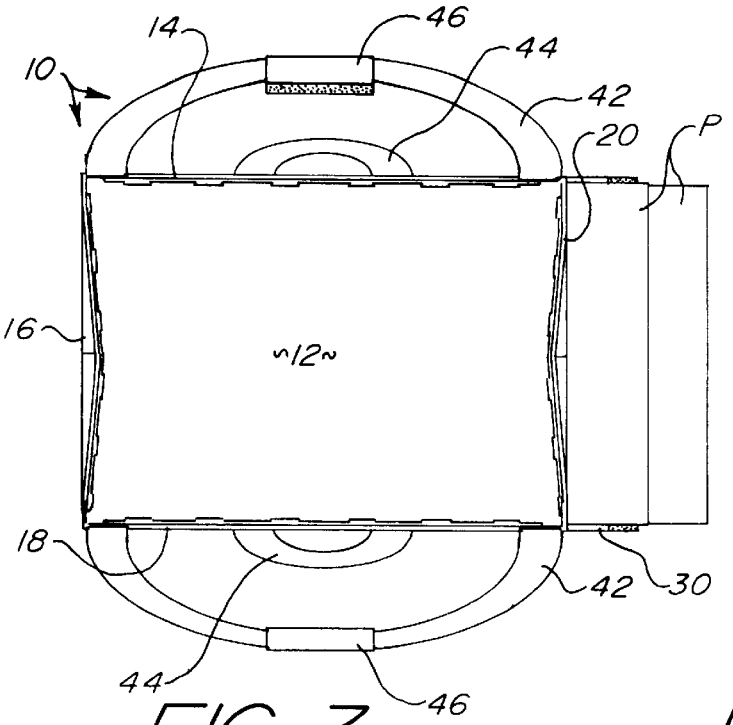
FIG. 3
FIG. 4
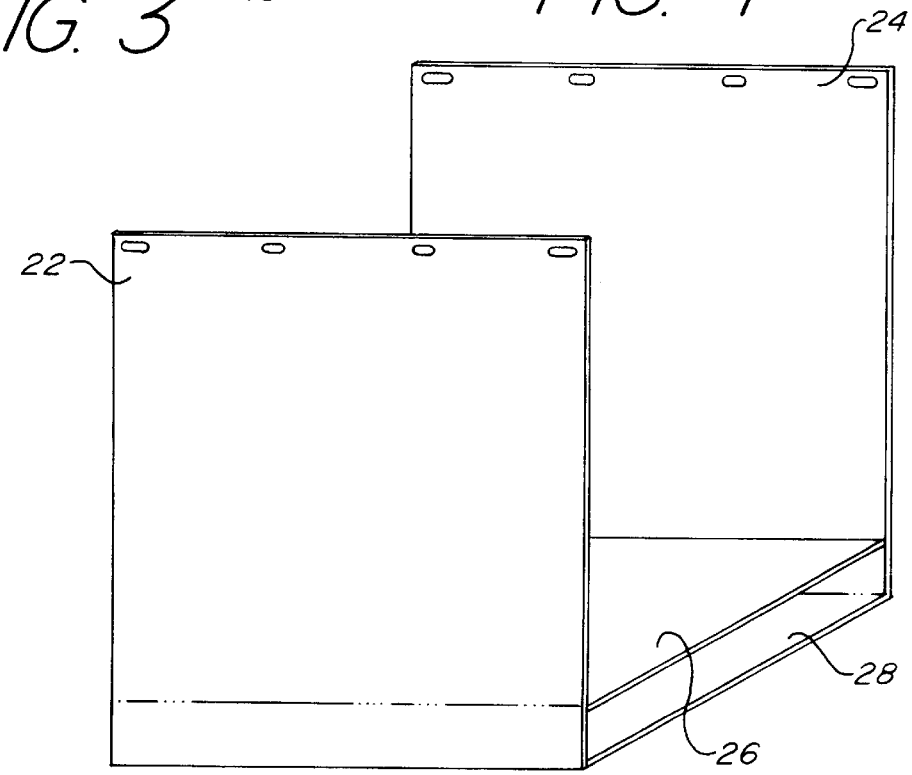

ART SUPPLY BAG

BACKGROUND OF THE INVENTION

1. Field of the Invention

The present invention relates to a dual compartmentalized art supply bag for carrying various supplies in addition to a paint pallet.

2. Background of the Prior Art

Carrying cases for supplies such as brushes, bottled paints, cleaners, etc., are very well known. So too are carrying vessels for holding paint pallets so that the paints do not bleed into one another. However, a carrying case that can easily and adequately hold and carry various supplies of an artist as well as the paint pallets in not known.

Therefore, there is a need in the art for a carrying case that can hold the various supplies required by an artist including brushes, knives, as well as personal items such as food, water, and the like. Furthermore, such a case must also be able to hold a paint pallet in a safe and secure manner without causing the various paints on the pallet to interfere with one another. Ideally such a device will be of simple design and construction and will be relatively easy to transport.

SUMMARY OF THE INVENTION

The art supply bag of the present invention addresses the aforementioned needs in the art by providing a bag that is capable of holding various sundry items required by an artist as well as a paint pallet. The art supply bag holds the pallet in a safe manner during transit.

The art supply bag of the present invention is comprised of a generally rectangular shell member having a base with a first wall, a second wall, and a third wall extending upwardly from the base with the second wall attached to the first wall and the third wall. A fourth wall attaches to the first wall and the third wall and is disposed in spaced apart relation to the base. A support structure having a first side support member and a second side support member joined by a first base support member and an optional second base support member is disposed within the shell member with the first side support member being generally parallel to the first wall. The support structure separates the shell member into a first compartment and a second compartment. A flap is attached to the base and is removably securable to the fourth wall. Flanges can be attached to the top of each of the four walls to add support to the shell member. A first pair of handles and a second pair of handles can be attached to the device with the second and fourth flanges and the second and fourth walls each notched to facilitate the use of the second pair of handles. Casters can be added directly to the art supply bag or to a frame onto which the art supply bag can be attached. Pockets can be located on one or more of the walls either interior or exterior of the shell member or both.

A user places desired items into the art supply bag through its open top and rests them upon the first base support member within the shell member. A paint pallet is stored in the compartment formed between the first base support member and the base of the shell member (or second base support member) with the flap providing access thereto. The device may be transported via the handles, with or without the assistance of the casters or frame.

BRIEF DESCRIPTION OF THE DRAWINGS

FIG. 3 is a side elevation view of the support structure.

FIG. 4 is a perspective view of FIG. 3

Similar reference numerals refer to similar parts throughout the several views of the drawings.

DESCRIPTION OF THE PREFERRED EMBODIMENT

Figure 2:
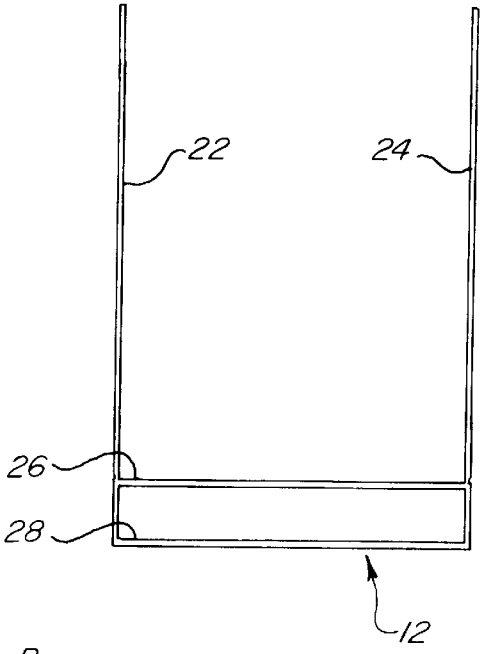
FIG. 2 is a bottom plan view of the art supply bag.
Figure 1:
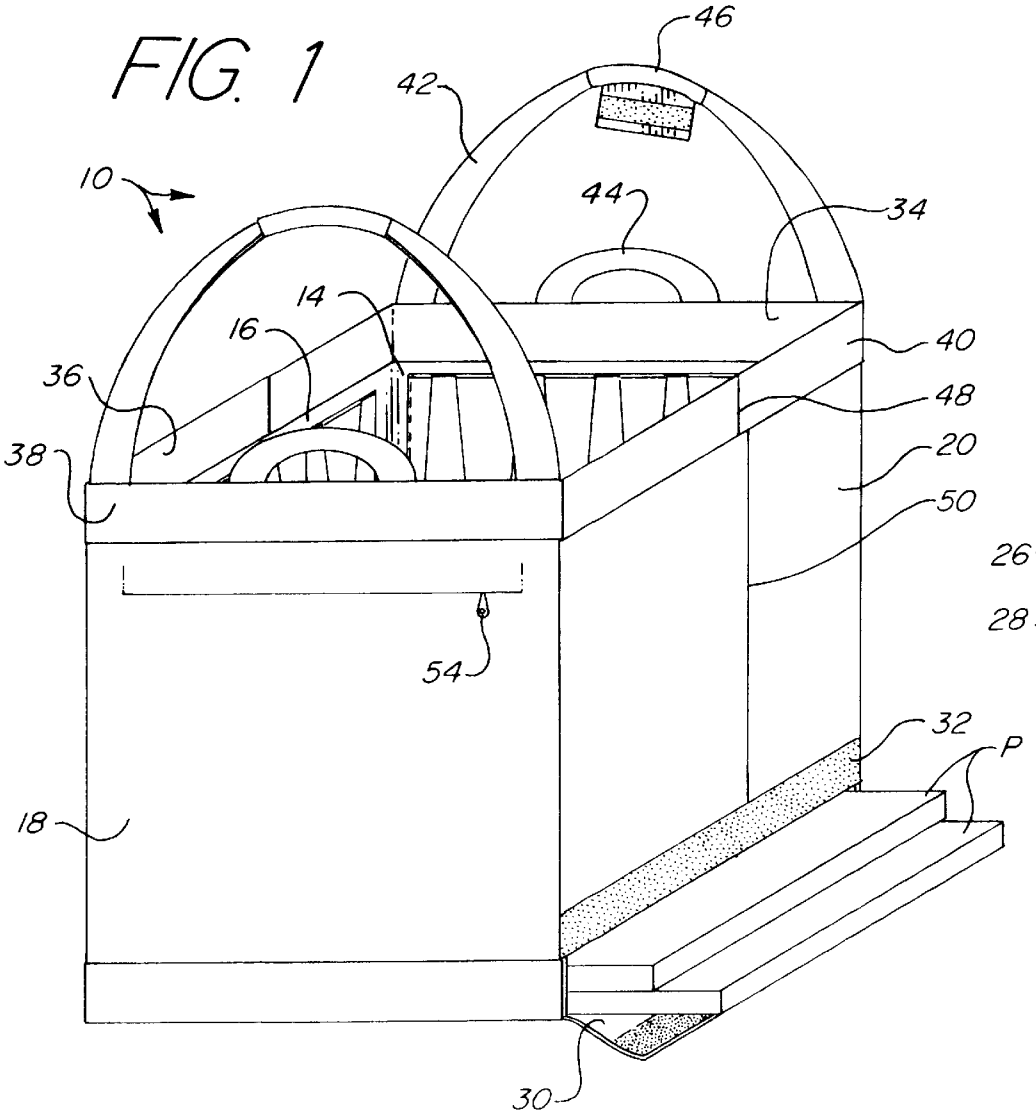
FIG. 1 is a perspective view of the art supply bag of the present invention.
Figure 5:
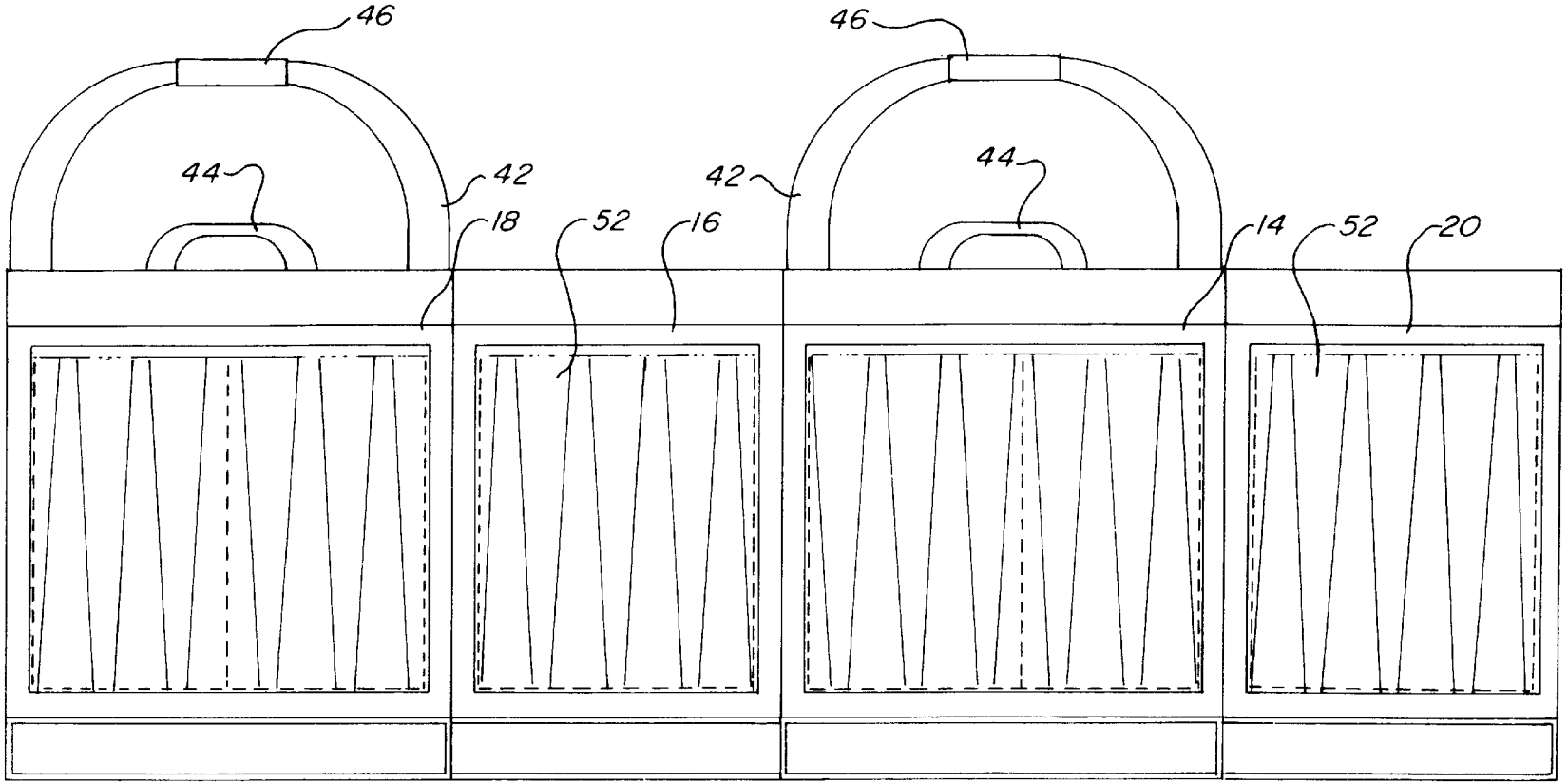
FIG. 5 is a view of the art supply bag in an unfolded disassembled configuration.
Figure 6:
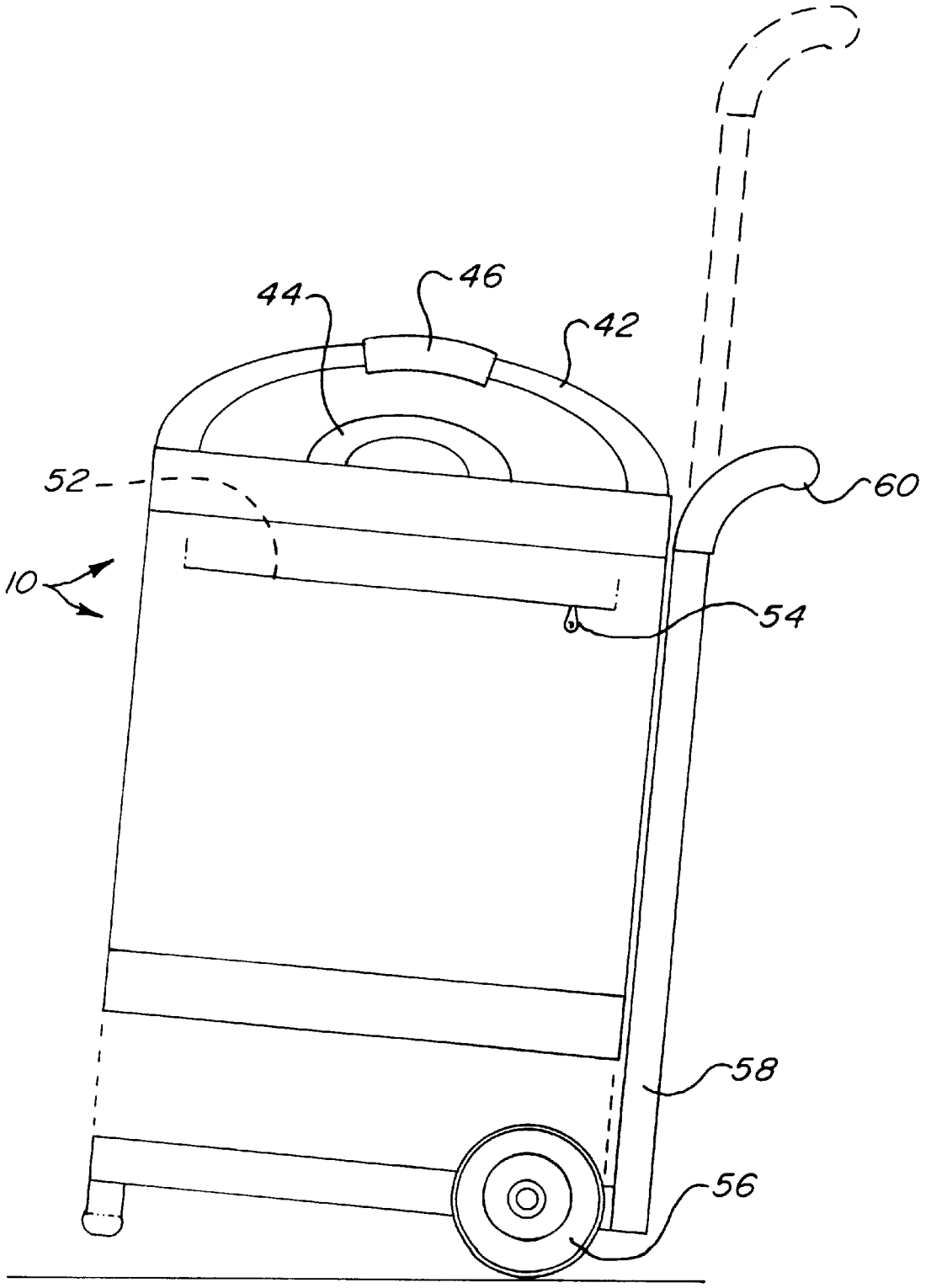
FIG. 6 is a perspective view of the art supply bag attached to a frame with casters.

Referring now to the drawings, it is seen that the art supply bag of the present invention, generally denoted by reference numeral 10, is a generally rectangular shell member having an open top and a base 12. A first wall 14 extends upwardly from the base 12, while a second wall 16 extends upwardly from the base 12 and attaches to the first wall 14. A third wall 18 extends upwardly from the base 12 and attaches to the second wall 16. A fourth wall 20 attaches to the first wall 14 and the third wall 18 and is spaced apart from the base 12. A support structure is comprised of a first side support member 22 and a second side support member 24 joined by a first base support member 26 and an optional second base support member 28 and is disposed in within the shell member such that the first side support member 22 is generally parallel with the first wall 14. The first base support member 26 of the support structure separates the device 10 into a first compartment and a second compartment. The first side support member 22, the second side support member 24, the first base support member 26, and the second base support member 28 are each formed from a generally rigid material. A flap 30 provides access to the second compartment and is attached to the base 12 and is removably securable to the fourth wall 20. Removable securement of the flap 24 to the fourth wall 20 can be accomplished by providing cooperating hook and loop material 32 (illustrated), snaps, a zipper, or any other securement means known in the art.

A first flange 34 is attached to the first wall 14, a second flange 36 is attached to the second wall 16 and the first flange 28, a third flange 38 is attached to the third wall 16 and the second flange 30, and a fourth flange 40 is attached to the fourth wall 16, the first flange 34, and the third flange 38. Each of the four flanges 34, 36, 38, and 40 is formed from a semi-rigid material such as leather, etc., and further aids the shell member in retaining its generally rectangular shape.

A first pair of handles 42 are attached to the device 10 while a second pair of handles 44 are also attached to the device. A securement loop 46 can encompass each of the first pair of handles 42 for ease of holding of the first handles 42. A first notch 48 is located on the second flange and the fourth flange while a second notch 50 is located on the second wall 16 and the fourth wall 20 in order to facilitate use of the second pair of handles 44 which provide a tighter closure of the open top. A least one pocket 52 can be located on at least one of the first wall 14, the second wall 16, the third wall 18, or the fourth wall 20, either internally within the shell member, externally outside the shell member, or both. The pockets 52 can but need not be closeable with any desired device such as the illustrated zipper 54. A pair of casters 56 can be attached to the device 10 or, as illustrated, can be located on a frame 58 which is itself attached to the device 10. The frame 58 can have a handle 60 which may be telescopically retractable.

In order to use the art supply bag 10, various sundry items are stored in the first compartment with the first base support member 26 acting as the base of the first compartment. A paint pallet P is stored within the second compartment and secured therein by closing the flap 30. The general rigidity of some of the components of the art supply bag 10 serve to protect the stored pallet P within the second compartment. The art supply bag 10 is transported using the first pair of handles 42, the second pair of handles 44, or by using the frame 54.

While the invention has been particularly shown and described with reference to an embodiment thereof, it will be appreciated by those skilled in the art that various changes in form and detail may be made without departing from the spirit and scope of the invention.

I claim:

1. An art supply bag comprising:

a shell member having an open top and comprised of a base, a first wall extending upwardly from the base, a notched second wall extending upwardly from the base and the attached to the first wall, a third wall extending upwardly from the base and the attached to the second wall, and a notched fourth wall attached to the first wall and the third wall;

a support structure, comprised of a rigid first side support member and a rigid second side support member joined by a rigid first base support, disposed within the shell member such that the first side support member is generally parallel with the first wall;

a flap attached along the length of the base and removably securable to the fourth wall;

a first flange attached to the first wall;

a second notched flange attached to the second wall and to the first flange;

a third flange attached to the third wall and to the second flange; and a fourth notched flange attached to the fourth wall, to the first flange, and to the third flange a second rigid base support member disposed between the first side support member and the second side support member in spaced apart orientation to the first base support member;

a first pair of handles attached to art supply bag; and a second pair of handles attached to the art supply bag.

2. The art supply bag as in claim 1 further comprising a securement loop encompassing each of the first handle pairs.

3. The art supply bag as in claim 1 further comprising at least one pocket located on at least one of the first wall, the second wall, the third wall, and the fourth wall.

4. The art supply bag as in claim 1 further comprising a pair of casters one each attached to a respectice one of the first wall and the third wall.

5. The art supply bag as in claim 1 further comprising a frame attached to the second wall.

6. The art supply bag as in claim 1 further comprising a closure means for securing the flap to the fourth wall.

7. The art supply bag as in claim 6 wherein the closure means comprises cooperating hook and loop material.

* * * * *